US006584703B1

(12) United States Patent
Mäenpääet al.

(10) Patent No.: US 6,584,703 B1
(45) Date of Patent: Jul. 1, 2003

(54) METHOD FOR CONTROLLING THE MOISTURE OF A WEB IN MACHINE DIRECTION ON A COATING MACHINE AND CALENDER

(75) Inventors: Tapio Mäenpää, Helsinki (FI); Vesa Ijäs, Viiala (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/914,656

(22) PCT Filed: Mar. 2, 2000

(86) PCT No.: PCT/FI00/00167

§ 371 (c)(1),
(2), (4) Date: Oct. 1, 2001

(87) PCT Pub. No.: WO00/52266

PCT Pub. Date: Sep. 8, 2000

(30) Foreign Application Priority Data

Mar. 4, 1999 (FI) ..... 990475

(51) Int. Cl.[7] ..... F26B 3/00

(52) U.S. Cl. ..... 34/446; 34/444; 34/445; 34/448; 34/451

(58) Field of Search ..... 34/444, 445, 446, 34/448, 451, 486, 528

(56) References Cited

U.S. PATENT DOCUMENTS

| | | | | | |
|---|---|---|---|---|---|
| 4,087,568 | A | | 5/1978 | Fay et al. | 427/8 |
| 4,202,112 | A | * | 5/1980 | von der Eltz et al. | 34/266 |
| 4,498,864 | A | * | 2/1985 | Roth et al. | 432/8 |
| 4,701,857 | A | * | 10/1987 | Robinson | 700/208 |
| 5,377,428 | A | | 1/1995 | Clark | 34/446 |
| 5,715,158 | A | | 2/1998 | Chen | 364/150 |
| 5,718,060 | A | * | 2/1998 | Mori | 34/446 |
| 6,446,356 | B1 | * | 9/2002 | Hamstrom et al. | 34/451 |
| 6,490,813 | B1 | * | 12/2002 | Oechsle | 34/445 |

FOREIGN PATENT DOCUMENTS

| | | | |
|---|---|---|---|
| DE | 37 41 128 | 6/1988 | D21F/7/06 |
| WO | 98/41805 | 9/1998 | F26B/25/22 |

* cited by examiner

*Primary Examiner*—Ira S. Lazarus
*Assistant Examiner*—Kathryn S. O'Malley
(74) *Attorney, Agent, or Firm*—Cohen, Pontani, Lieberman & Pavane

(57) ABSTRACT

The invention relates to a method by means of which the machine-direction moisture of a web being calendered or coated and calendered can be controlled in an optimal manner that takes into account moisture content changes along the entire path of the coating and drying process. Advantageously, all the dryers and the calender of the coater section are controlled in an integrated manner in order to obtain a controlledly processed product which is optimized in regard to energy consumption and product quality. Each process section and unit contributing to the drying of the web is identified by means of a mathematical submodel describing the specific evaporation rate in the respective process section/unit and, by chaining these submodels, a composite model is compiled for the entire process, whereby the composite model makes it possible to manage the drying operation in the process so that the individual units are controlled as a portion of the overall process. In its simplest form, the composite model of the overall process comprises a submodel describing the behavior of the calender and at least one partial submodel describing the web processing unit preceding the calender.

32 Claims, 4 Drawing Sheets

METHOD FOR CONTROLLING THE MOISTURE OF A WEB IN MACHINE DIRECTION ON A COATING MACHINE AND CALENDER

PRIORITY CLAIM

This is a national stage of PCT application No. PCT/FI00/00167, filed on Mar. 2, 2000. Priority is claimed on that application, and on patent application No. 990475 filed in Finland on Mar. 4, 1999.

FIELD OF THE INVENTION

The present invention relates to a method based on a novel control and steering strategy for use in the drying process of a paper web or similar coated web material such as board in coater sections in which the web to be coated is passed via a coater station or applicator section including at least one applicator apparatus, dryers and a calendar.

The invention also relates to a method for controlling web moisture during on-line calendering, particularly supercalendering, in conjunction with the drying process of a papermaking machine in the manufacture of uncoated paper grades.

BACKGROUND OF THE INVENTION

In the coating of a web of paper or board, the surface of the web is first coated with a furnish containing coating pigments slurried in water. After the application and smoothing of the coating mix, the coating applied to the web surface as well as the underlying base web must be dried to a sufficiently low moisture for final use or further processing. Subsequent to the coating process, the sheet can be calendered in different ways using, e.g., a machine calender, a soft-nip calender, a super-calender or other type of multinip calender. In all units of these calender variants, the sheet gloss and smoothness are improved utilizing heat, moisture control and varying nip pressure in combination. Hence, a major portion of the energy consumed in the production of coated paper grades is lost in drying the web during the different steps of postprocessing, which means that energy management in drying is an extremely vital factor contributing to the profitability of production. Correct drying technique also affects the quality of the produced paper grade. Another parameter highly pertinent to the quality of produced paper is the control of the machine-direction moisture profile, that is, the moisture of the base paper, which must be kept at a constant level during the run. The web moisture content affects particularly the paper web behavior in calendering and printing. As modern production lines are equipped with on-line calendering, wherein the coated web is passed directly to a calender, the moisture profile of the running web has an insufficient time to reach a uniform equilibrium state prior to calendering, a situation which is in contrast to that attainable in the traditional off-line calendering, wherein the coated web was stored in a machine reel prior to subsequent calendering. Correspondingly, the transport chain of paper from the mill to printing houses and other users has been speeded up, whereby the moisture even in uncalendered paper does not necessarily have enough time to stabilize and reach a sufficiently low level prior to printing. In coating, the web moisture content affects the penetration of water into the base web during the application of the coating mix and, resultingly, the change of coating solids content after coating. As variations in the solids content of the coating are reflected in plural parameters in the application process, it is important to keep the web moisture during application and drying accurately within proper limit values in order to attain a uniform and desired final quality of the product.

Correct web moisture is particularly important in calendering and, moreover, in supercalendering. Usually, the uncoated or coated paper web entering the calender is too dry for direct calendering. As a web of higher moisture is easier to calender than a web of lower moisture, the web is moistened at least in supercalendering by means of steam jets even in several stages during calendering in order to reach the optimum result from multistage calendering in terms of web surface quality and strength.

Conventionally, a coated web is dried immediately after the application of coating using noncontacting dryers, which step may be followed when necessary by cylinder dryers and other dryers of the contacting type. The moisture content of the running web is measured at multiple points along the web travel in the coater apparatus and, on the basis of the measurement data, the drying effect of each dryer is individually adjusted so as to attain a proper web moisture over the cross-machine width at the respective measurement point as well as an average moisture content that stays between given limits during a run, the latter requirement meaning that the machine-direction moisture profile is controlled to a given set value. The overall drying capacity is adjusted to a suitable basic level based on test runs and data accumulated from a long-term experience in the art, and the individual dryer effects are then fine-tuned during the run on the basis of measurement data either automatically or manually. Conventionally, one of the dryers or one dryer group is selected to perform as the controller of the final moisture level, whereby the heating power input to the selected dryer group(s) is adjusted by means of a feedback signal obtained from the measurement system. In this arrangement, the other dryers are driven under manual control. Such a control scheme responds very tardy and compensation for the slow response of dryer control is difficult to implement in situations requiring a fast change of dryer effect levels. Furthermore, the web temperature prior to the coater apparatus must be kept sufficiently low to avoid floccing of the coating mix being applied. Hence, proper control of the drying effect is important particularly in the final stage of the dryer section prior to the subsequent coating step. The web temperature also affects the final quality of the coated web.

As concurrent methods are awkward to use in the control of the drying process so that the web in each stage could be kept at an accurately optimized moisture, it has been customary, particularly in off-line supercalendering, to first bring the dried web down to a minimum moisture, whereupon it is rewetted to a suitable moisture for calendering. In the nips of the calender rolls, the excess moisture absorbed into the web from steam treatment is removed, but even here it is difficult to control the moisture in the end product as well as in its intermediate stages, because moisture variations as small as a few per cent already will affect the end product quality. If deviations in the initial moisture content of the web are allowed, these will be reflected in the quality of the end product notwithstanding the situation that measurements after the calendering step would indicate a desired value of the end product moisture.

Particularly in situations of changing running conditions or when starting up the machine, known in the art as the run-up, the elevation of the dryer drying effect levels to correct values and adjustment of the same to proper run-time levels requires excellent skills from the personnel operating the machine. However, carrying out the procedure of setting the dryer evaporation effect levels in the coater section and the calender steaming rates and roll temperatures to correct values under run-up or changing process conditions takes time, during which the produced paper or board falls short of the specified quality requirements thus necessitating dumping of the web into the pulper. Hence, it is advantageous to minimize the durations of run-up and process value change times in order to achieve improved production efficiency at the machine. The above control scheme is also extremely clumsy in the optimization of drying energy consumption inasmuch it relies on the control of each dryer unit separately, whereby the mutual evaporation effect ratios between the dryer units are difficult to alter in an uncomplicated manner. Furthermore, a failure in one or a greater number of the dryer units is difficult to compensate for, because the process is designed for operation with all the dryer units being functional.

SUMMARY OF THE INVENTION

It is another object of the present invention to provide a method suited for controlling the machine direction moisture profile of a web to be calendered or to be coated and calendered in a manner optimized to respond to any moisture changes throughout the entire coating/drying process. In practice this approach means the application of a comprehensive control scheme covering all the dryer units and calender of a coater section in an integrated manner in regard to energy consumption and product quality in order to attain an optimal end result.

The goal of the invention is achieved by way of forming a mathematical submodel of specific moisture evaporation rate for each process section and device contributing to the web drying process and then chaining the thus obtained individual submodels so as to form a composite model of the overall process, the model being suited for managing the drying phenomena during the entire process so that each individual unit of the equipment layout is controlled as a part of the overall process. In its simplest form, the overall process model is formed by a submodel of the calender and a submodel that at least partially characterizes the unit preceding the calender.

The invention offers significant benefits.

By virtue of the model according to the invention, it is possible to directly compute the moisture content of the web at the outgoing side or each dryer and calender nip, provided that the specific evaporation rate at the dryer or the nip, as well as at an associated open draw, and the web moisture at the ingoing side are known. After the chaining of the individual submodels, the web moisture content can be computed at different points along the machine, the most important parameter value obviously being the final moisture content of the web. With the help of the model, the dryer effects may be adjusted according to the individual properties so that the characteristics of different types of dryers are optimally taken into account. Since infrared dryers feature a quick response, they may be used, e.g., during run-up for controlling the overall effect of the dryer group, thus allowing the evaporation effect levels of other dryers to be elevated in a more relaxed manner to their steady-state values during the normal run by way of compensating for the delay of dryer warm-up with the help of delay terms adapted into the model. The use of delay terms makes it possible to manage actual process response delays, too.

Since the invention provides a control scheme for the overall process, it allows the evaporation effects of the dryer units to be divided therebetween in a desired manner and, particularly in the case of failure in one dryer, the drying effect lost thereby may be compensated for by the other dryer units thus permitting operation of the coater section uninterrupted by a servicing shutdown. Equally, as the initial moisture content of the web as well as the amount of moisture added thereto by the applied coating or through wetting are known, the model gives tools for computing an estimate for the web moisture at different points along the process and, particularly, prior to upwinding. In fact, the model allows the web final moisture content to be computed so accurately that production may be continued controlled by the model even when the moisture measurement devices are down.

The overall performance offered by the invention gives a faster and more accurate control result than that available by way of manual control combined with feedback loops controlling the individual drying units.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

In the following, the invention will be examined in greater detail by making reference to the appended drawings in which.

DETAILED DESCRIPTION OF THE PRESENTLY PREFERRED EMBODIMENTS

Figure 1:
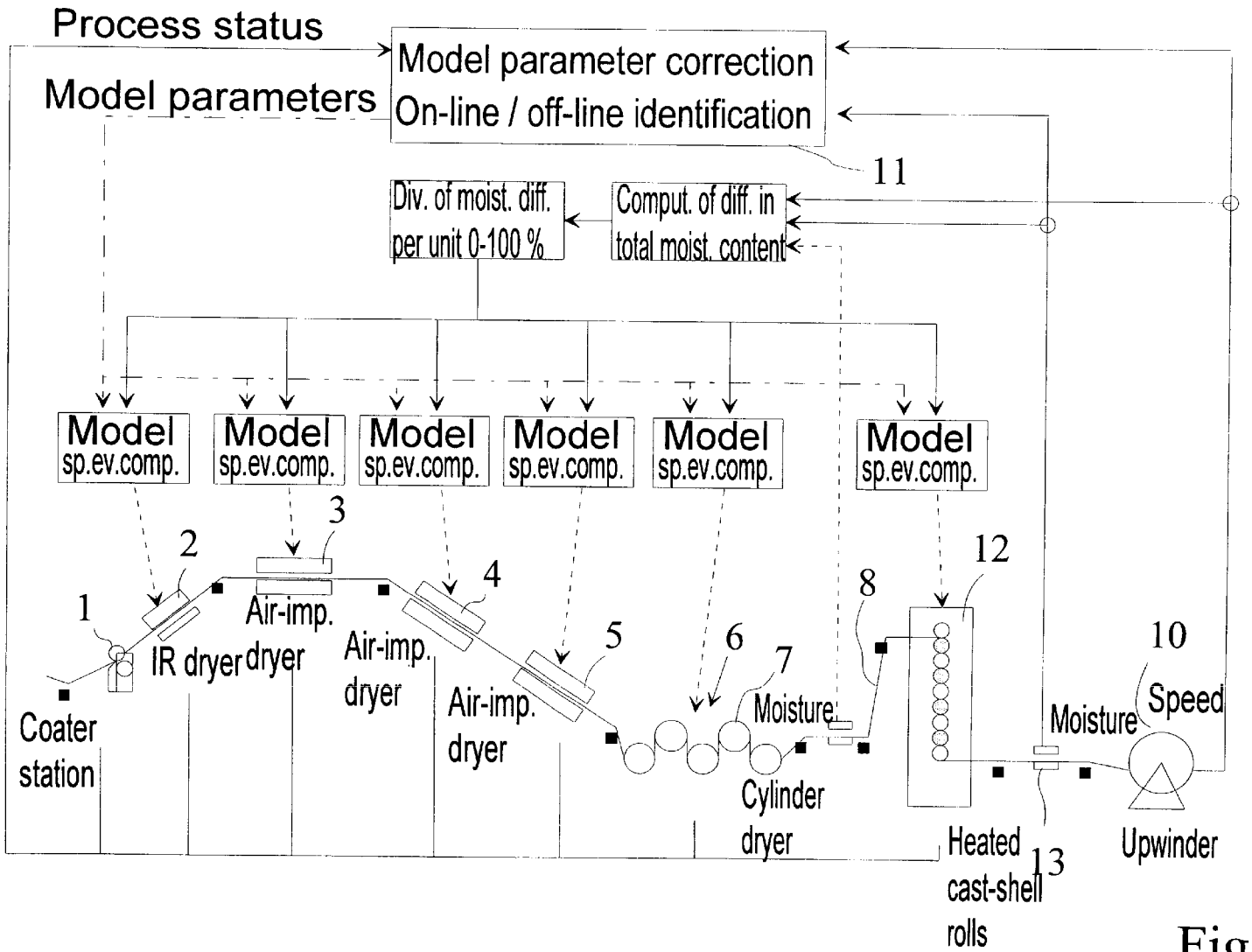
FIG. 1 shows a coater section or a portion thereof comprising one coater station, dryers and a supercalender.

Referring to FIG. 1, the diagram shown therein schematically illustrates a layout comprising one coater station 1 with dryers 2–6 connected thereto and a supercalender 12 followed by an upwinder 10, whereby the functions related to the drying effect control of the dryers 2–6 and the calender are illustrated as a block diagram. In the downstream travel direction of a web 8, the first unit is a coater station 1 serving to apply coating or other web treatment substance such as surface size to at least one side of the web. As the type of coater station used is irrelevant to the implementation of the invention, the coater may be any suitable applicator apparatus such as a short-dwell coater, film-transfer coater, blade coater or spray coater. The coater station may be used for applying the coating to one side of the web 8 only as is customary, or to both sides, as required. In the case of one-sided coating application, this diagram represents a conventional layout, wherein the web has been coated by one or more layers of coating on its both sides prior to the entry of the web to the last coater station located preceding the calender. The web moisture control in the preceding stages may be arranged through modeling the behavior of the stages in the same manner as is described in the present exemplifying embodiment and, in fact, a more detailed description on the control scheme of a section comprising two coater stations can be found in a parallel patent application titled "Method of controlling the machine-direction moisture profile of a web on a coater" (FI Pat. Appl. No. 990,474), filed simultaneously with the present application. Obviously, the construction of dryers 2–6 is dependent on whether two-sided or one-sided coating is performed in a single coater station, but nevertheless the function of any one of the dryers may be modeled in the same fashion in accordance with the invention.

Next downstream to the coater station 1 are located first an infrared radiant dryer 2, three air-impingement dryers 3 to 5, a dryer cylinder group 6 comprising a plurality of dryer cylinders 7, a supercalender 12 and an upwinder 10. On the dryer cylinder group 6, the web 8 is dried to a moisture suitable for final calendering and next the web 8 is passed via a moisture content gauge 13 to the upwinder 10. One moisture content gauge 13 is also located between the dryer cylinder group 6 and the supercalender 12.

While the calender used in this exemplifying embodiment is a supercalender, also other types of calenders such as multinip calenders are applicable. Inasmuch the web moisture may be affected in a number of different ways on a multinip calender, as well as on a supercalender, and since on these calender types among all the possible calendering methods the web moisture has the highest impact on the end quality of the web, the invention offers its greatest benefits in the manufacture of super-calendered or multinip-calendered paper grades. Supercalenders also allow a model to be devises having an appreciably wider latitude of parameters over those describing the behavior of other calender types due to the fact that each roll nip and the possibly associated web wetting and drying devices may be modeled separately and then combined into a composite model of the calender station. One or more of the calender rolls may be a soft-covered polymer-surfaced roll and/or a paper-surfaced roll or other kind of soft-covered roll. In the calender roll stack, one or more of the rolls having a chilled-steel cast shell may be replaced by a heated thermoroll. Furthermore, it is possible to equip the calender with such external dryers, e.g., inductively acting dryers or infrared, convection or contact dryers, that are not conventionally used in a standard coater station. The method is capable of managing a normal steady-state production run situation or a dynamic transition situation toward a steady-state production run. The method accommodates both changes in the machine speed during normal steady-state production as well as changes occurring dynamically in the transition phase toward steady-state production during the so-called machine run-up.

The process is controlled by means of a computer. The actual implementation of the computer may comprise a module running under the software of the coater section control computer, or a separately allocated computer or micro-processor serving the moisture control task alone or a physically distributed software and database package. The control system contains an evaporation submodel for each one of the dryers and calenders or calender nips, as well as a composite evaporation model compiled from these submodels. Additionally, the data base 11 of the control system serves to store the process status data, that is, the real-time status of both the machine and the model obtained by way of measurement or directly from the computational data submitted by control system of the coater section. The status data includes such parameter values as the coater section status comprising the applied coat weight, solids content thereof and other similar factors, dryer evaporation effect levels, calender roll temperatures and amount of water possibly applied to the web for wetting the same, the final moisture after the dryer units and after calendering and the web speed as measured at the upwinder 10. Computational data obtained from the calender include the specific evaporation effect imposed by dryer units external to the calender roll stack and the specific evaporation rate related to the heated thermorolls and the open draws.

Conventionally, the moisture of web passed from the papermaking machine to the coater is in the range of about 1.5–4%, while the moisture of a treated web in the order of 4–6%. The web moisture increases down-stream in the coater section both within each subsystem and also in the delivery of the web from one subsystem to another, because the longer the wet coating has traveled on the base web the deeper the moisture has penetrated therein and the more difficult it is to remove by evaporation. The moisture content values of the web may vary widely during the different phases of web treatment, and also the final and initial moisture contents of the web may vary according to the grade being manufactured. If desired, the initial moisture content of the web may be computed on the basis of the amount of evaporation during a run, this value being obtained from the model, and the final moisture content of the web, this value being measured prior to the upwinder. Since the moisture distribution measured in the thickness direction of the web affects the calendering result, the model may be utilized to vary the outcome of calendering, thus permitting the use of the invention for controlling the moisture distribution in the thickness direction of the web during the different phases of the process so as to reach an optimal calendering result for each paper grade.

Accordingly, the method according to the invention aims to provide an accurate overall control of the machine-direction moisture profile of the web along its entire downstream travel through the coater section and the calender in all production situations and, particularly, during the dynamic transition phase toward the steady-state production run condition, that is, during machine run-up and when changes occur in the machine speed or the coating process parameters. The present method is capable of controlling a plurality of coater section dryers and a calender simultaneously so that the target value of web moisture is attained optimally. In the novel approach according to the invention, each drying or wetting unit is formulated with the help of a mathematical submodel describing the specific evaporation behavior of the unit, whereupon the submodel is utilized in the comprehensive control strategy for computing the unit-specific set values. The thus formulated specific evaporation rate models are used in a chained manner for modeling the overall process, complemented with certain measurement results obtained from the process. The parameters of the mathematical modeling equations may be updated on either per unit or per operating point basis using either off-line or on-line techniques. The thus obtained computational model can be brought to match exactly with the operation of the coater section for different kinds of manufactured product grades and varying process conditions.

The method can be applied to both so-called off-machine and on-machine sections, and it is capable of performing dryer control functions under a normal steady-state production run situation as well as during dynamic transition phases toward a normal production run state. In the context of the present invention, a normal steady-state production run situation is understood to refer to a condition in which no changes occur in the machine speed or, if changes do occur, they are of a type that will not be reflect in the product quality. Such change and transition situation(s) is/are represented by changes in machine speed and start-up of section operation. The measurements values of the process quality monitoring system and other values such as the web moisture, basis weight, coat weight, coat solids content and web temperature sensor signals obtained from the coater section control system serve as the input signals of the method. The measurement sensors of the process quality monitoring system may be located either after the last dryer unit in each coater station and preceding the upwinder, whereby the measurement system represents a comprehensive implementation or a portion of the so-called intermediate points of moisture measurement can be omitted, whereby the method may use the web moisture estimates which are computed from the evaporation model and bear an accurate relationship with the actual situation along the web travel, particularly when the parameters of the modeling equation are updated in real time.

Based on the mathematical models, the present method computes the specific evaporation rate, e.g., as $kgH_2O/m^2/h$ for each dryer or process unit contributing to the drying process. The computations take into account the coater stations, infrared radiant dryers, air-impingement dryers, cylinder dryers and other dryers associated with the coater section, as well as the open draws between the dryer units and naturally the calender proper. Open draws form an important part of the modeling task and must be included in the composite model, because moisture evaporation also takes place on these portions of the web travel from the hot web exiting the dryers. The mathematical models of the roll stacks of the calender cover the computation of the specific evaporation on heated chilled-steel cast shell rolls as well as the specific evaporation rate of the dryers located externally to the calender section if such dryers are used in the method.

On a coater station, the coating applied to the surface of the web carries along a certain amount of excess water that must be removed on the dryers. When the initial moisture content of the web, as well as the amount of applied coating and the moisture content of the coating are known, it is possible on the basis of the web speed to compute the required overall evaporation effect and to divide it between the different dryers. The goal is to control the so-called intermediate moisture of the web after each coater station, as well the final moisture of the finished product to desired target values by means of steering the coater section dryers and the calender as an integrated system. The specific evaporation computation utilizes measurement data gathered on web moisture, temperature, speed and on the ambient air temperature and humidity. With the help of the specific evaporation models, it is possible to compute an estimate for the web moisture after each dryer and for the final moisture of the paper web exiting from the calender. Similarly, it is possible to compute the change in web temperature within each process unit and the exit temperature of the web at the outgoing side of each unit. A chained composite model for the entire system is obtained by combining the mathematical submodel equations that describe the behavior of the dryers, the calender and the open draws. Herein, the values of the web moisture and temperature computed for the outgoing side of a preceding dryer are used as the input values for the next drying or wetting device, that is, representing the moisture and temperature values of the entering web.

According to the method, the web intermediate moisture after each coater, the web moisture at the ingoing side of the calender and the final moisture of the finished product at the upwinder are controlled by means of specific evaporation submodels developed for the drying or wetting units of the coater section. With the help of these submodels it is possible to compute such set values of adjustment and control variables for each modeled unit that bring about the desired values of web intermediate and final moisture contents. The same approach also is used to manage a machine speed change situation. The control actions are carried out with the help of both closed-loop feedback circuits and feedforward circuits. Moisture measurement signals obtained from the process quality monitoring system are taken to the feedback circuit that adjusts the set values of one or more dryer units in the coater section. The feedforward circuit, which is employed to manage the dynamic transition states of machine speed change, uses set value estimates which are computed from the mathematical submodels of the specific evaporation rates for the final condition of the machine speed change state. This description, however, omits the details of the actual modeling techniques used inasmuch those skilled in the art have no difficulty in finding the needed mathematical tools in the literature.

The first step in the method according to the invention is to compute the specific evaporation rates for the different units of the production line. The specific evaporation rates as $kgH_2O/m^2/h$ are computed for the separate dryers of the coater section and the calender, or even for individual calender nips and open draws if so desired, using the computational facilities of the automation system of the production line or of a separate computing unit intimately communicating therewith. The mathematical submodels of the coater section dryers are developed separately for the coater stations, infrared radiant dryers, air-impingement dryers and cylinder dryers and other dryers possibly cooperating with the coater section, and for the open draws. Additionally needed are the submodels that describe the behavior of the calender. The mathematical submodels take into account the contribution of the characteristic control parameters of each unit and the effect of process variables on the overall specific evaporation rate. Such contributing variables include the web speed, the web initial moisture and temperature, the web basis weight, the coat weight, the solids content and composition of applied coating, air humidity, the lineal effect (kW/m) of the infrared radiant dryer, the temperature and flow rate of impinging air blown in the air-impingement dryer, the steam pressure and flow rate in cylinder dryers, the roll temperatures in the calender, the amount of wetting possibly applied to the web, the inlet and outlet temperatures of heating oil or water or the steam temperature and pressure at the thermorolls. As an outcome of the computation, the submodels give the specific evaporation rate for each unit, the web moisture at the outgoing side of the unit and the web temperature at a given point of interest when properly selected control variables are used in the equations.

With the help of data obtained from the process quality monitoring system, the characteristic parameters of the evaporation rate submodels may be corrected, e.g., as per paper grade and system operating status. In this fashion, the composite model can be tuned to accurately match the actual operating status and the behavior of the machine to be controlled. To this end, the estimate obtained from the model for the web moisture at a given point of the web travel, e.g., prior to upwinding, is compared with the actual moisture data obtained from the web measurement sensors. On the basis of this comparison, an error term is computed for the model that is then used in the correction computation for the model parameters. The correction computation may be carried out as either an off-line task within the automation system of the production line or other computing system connected thereto or alternatively, directly as an on-line task in the automation system, using appropriate computing routines such as the least squares method, for instance, or equivalent recursive algorithms. For this purpose, the units contributing to the web moisture are controlled according to a specific strategy so that all the units are set to a constant evaporation effect state, with the exception of the unit for which the equation parameters of the submodel are to be analyzed. During the parameter value update operation, the control signals of the unit being analyzed are appropriately varied in accordance with the parameter identification technique used, e.g., by way of imposing stepwise changes in the set value or super-imposing a PRBS (pseudo-random binary signal) on the set value output signals in order to cause a sufficient amount of changes in the system being analyzed so that the computational algorithm of the parameter identification technique will converge. The thus obtained parameter values of the modeling equations as per paper grade and process operating point can be stored in a separate database or in the grade-specific production control files of the process automation system.

According to the invention, moisture control along the downstream travel of the web takes place as follows. In the method described herein, a model-based web moisture controller computes from the actual measurement signal of the web moisture and the target value of the web moisture a control signal, whereby the computational process utilizes a composite model compiled from the mathematical submodels of the individual units included in the production line. The computation takes into account the specific evaporation rates of the units and the prevailing manufacturing process conditions. With the help of the submodels, such set values of adjustment and control variables are computed for each unit separately that are required to attain the desired intermediate and final values of web moisture. During dynamic-changes of machine speed, the control algorithm computes the need for drying effect change according to the change in web speed.

In a normal steady-state production run situation involving no change in web speed, a feedback-type control scheme is used, whereby the model input signals formed by the web moisture set value and the actual web moisture measurement information are processed into a feedback signal of moisture error, on the basis of which signal the control algorithm then performs required changes to an extend defined by the system operator in the drying effects of units selected to be controlled by the control computer. While all the dryers may be set to be controlled by a computer or, respectively, set for manual control, in the spirit of the invention the drying effect of at least one dryer must be steerable by means of a model running on a computer. Advantageously, also the calender is adapted for model-based control, whereby the calender should not be used as the sole unit responsible for the control of the final moisture of the web, but rather, the calender operation should be merely controlled so as to achieve the desired quality of the end product.

Herein, either an intermediate web moisture sensor 9 or a product quality monitoring sensor 13 placed in front of an upwinder 10 measures the actual value of the web moisture that is compared by the control program with the set value. On the basis of the difference between the set value and actually measured web moisture, the system computes the respective change of the overall moisture ($\Delta H_2O$) that should be accomplished by means of the units selected to be steered by the control computer. If the moisture difference signal has a positive sign, the specific evaporation rate must be increased. Respectively, a negative sign indicates a need for reduced specific evaporation rate. The overall value of required moisture change ($\Delta H_2O$) is divided between the units (i=1 . . . N) selected to be steered under computer control using such proportional percentage weight factors (0–100%) that the sum of the weighting factors always is 100%. Obviously, other weighting strategies are also possible in the division of moisture change, that is, to implement the required change in the distribution of the drying effect between the units. For instance, the weighting factors may be selected to be proportional to the available evaporation rate capacities on the modeled units or to the desired moisture values at the intermediate points. In this kind of proportional division, each of the selected units is allocated to handle so much of the overall moisture difference control task as is indicated by its weighting factor. The specific evaporation rate models are then used for computing the required changes in the set values of control signals given to each one of the selected units. After computation, the new set values are transmitted to the unit controllers that implement the changes in the set values.

Figure 2:
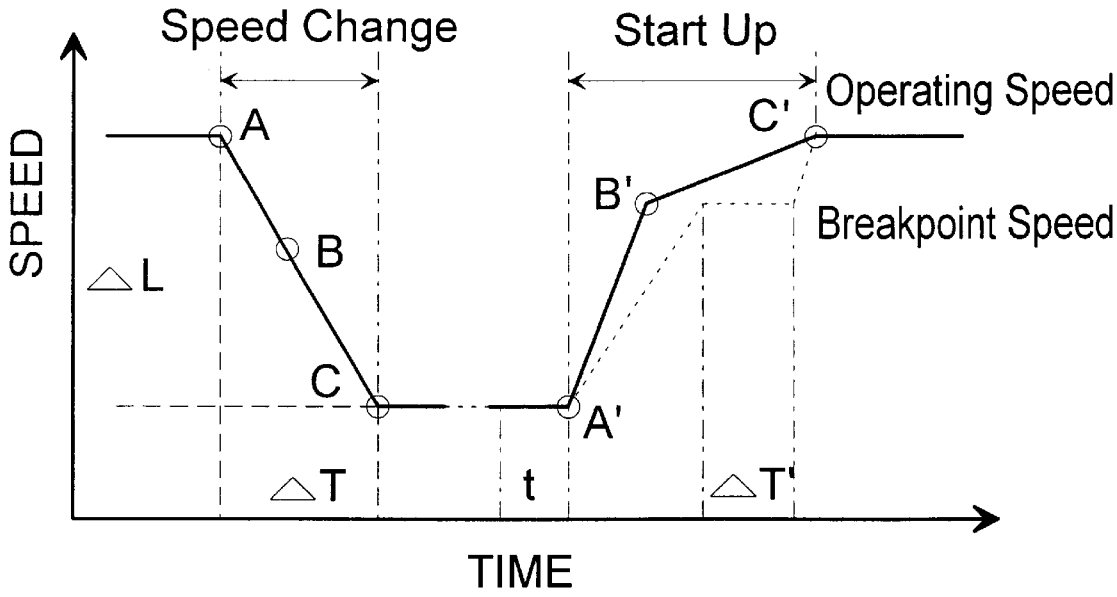
FIG. 2 shows a schematic plot of the machine speed when the web speed is changed.
Figure 3:
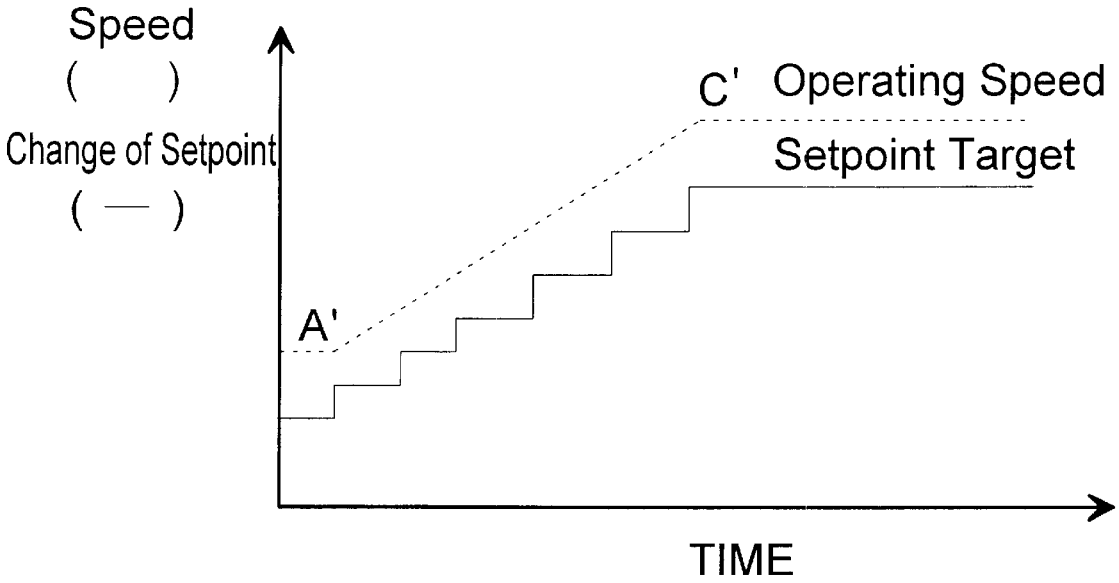
FIG. 3 shows a schematic plot of the control of the dryer effect at a change in the machine speed.

In FIG. 2 is shown a situation involving a change in the machine speed. In this case, the control scheme relies on a feedforward circuit. To perform a change in the machine speed from point A of the diagram to point C, the procedure goes as follows. The new set values required at point C for the drying units of the coater section are computed at point A using the submodel equations so that the correction to be made in the set values due to the machine speed change are taken into account. The new set values can be transmitted to the unit controllers either immediately at the start of the machine speed change (point A) or incrementally over the entire duration of the machine speed change phase as shown in the diagram of FIG. 3. The choice of either control strategy is dictated by the amount of machine speed change ($\Delta L$), duration of the change ($\Delta T$) and the dynamic behavior of the selected dryer or drying unit. During machine run-up, the control strategy can be, e.g., as shown in the right-hand plot of FIG. 2. The new set values required for the unit controllers at either point B' or point C' are computed at point A' with the help of the modeling equations. If the acceleration of the machine takes place via an intermediate point B', the corresponding set values for the target speed at point C' can be transmitted at either points A', B' or in an incrementally stepwise manner (see FIG. 3). For controlling such fast-response dryers as infrared radiant dryers, a desired number of incremental point values may be computed on the basis of the set value start and end points, whereby the incremental values are activated when the machine attains a speed corresponding a given set value. On the other hand, if the slow dynamic response at, e.g., air-impingement dryers and cylinder dryers, as well as at the calender (characterized by a delay time t) is taken into account, the set values corresponding to point C' for the selected units may be transmitted already at point (A'–t) or the delayed response may compensated for in the incremental control. The intermediate point B' is most conventionally used, e.g., for shutting down the coater stations. Herein, depending on the time span ($\Delta T'$), it is possible to compute also for point B' the set values of the unit controllers that are then used as the input values in the computation of variable set values for transition toward state C'. The method can also handle situations in which full-width moisture measurement information obtained from the product quality monitoring system or partial-width moisture profile measurements are utilized during machine speed changes or system run-up. In a partial-width moisture profile measurement, the moisture sensor of the product quality monitoring system may be of a so-called fixed type (nontraversing) or the sensor may be arranged to perform a traversing movement, that is, in the cross-machine direction, only for a partial width of the web covering the web by 0.5–1.0 m, for instance. In this case the arrival of a new, reliable moisture measurement value always triggers a corrective action performed with the help of the modeling equations or other correction computation on the estimates of set values transmitted to the dryers.

Figure 4:
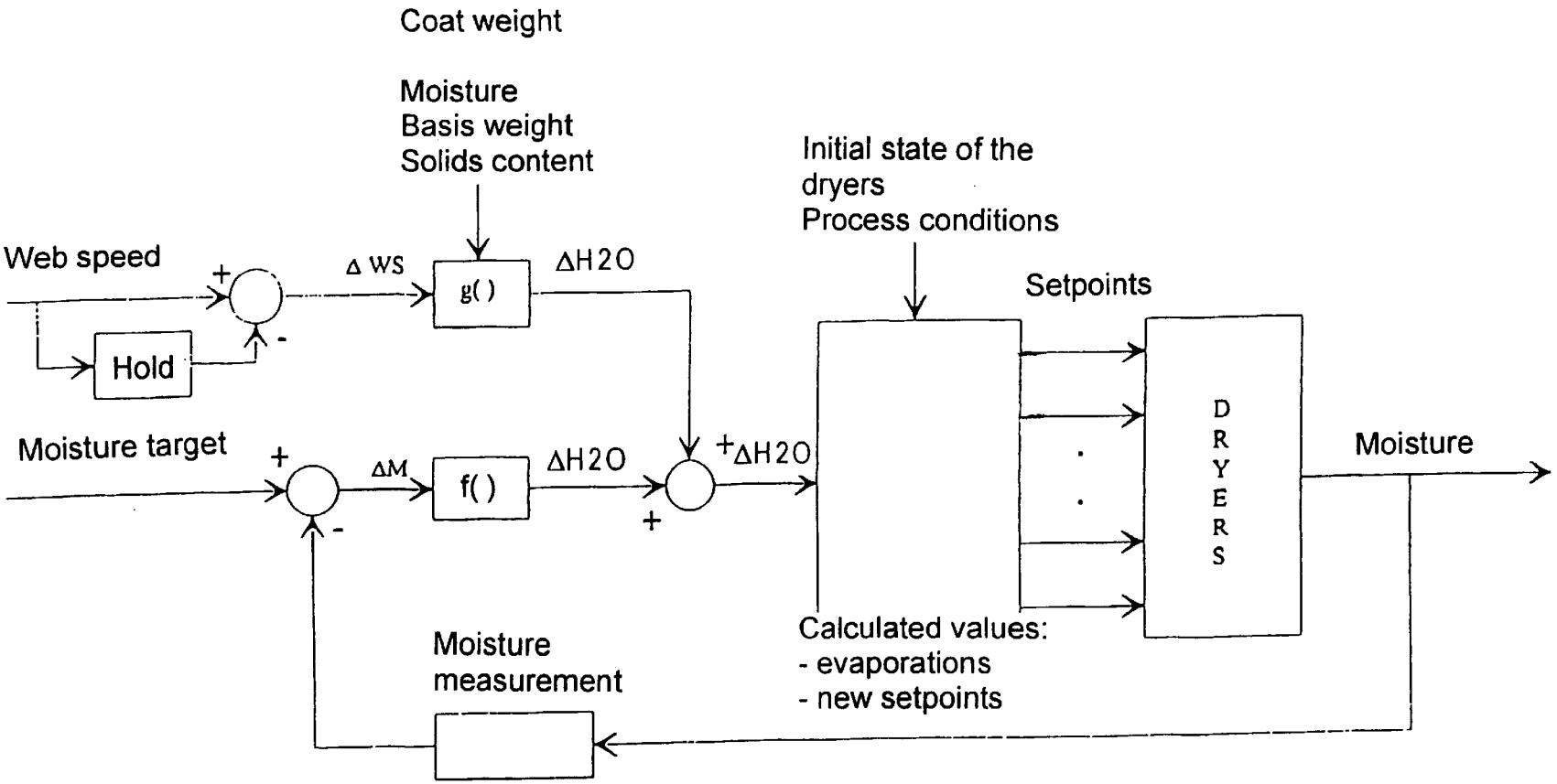
FIG. 4 shows block diagram of the present control method.

In FIG. 4 is shown the above-described control strategy in a slightly different diagram. The control scheme illustrated in this block diagram is equivalent to that shown in FIGS. 1 and 2. The left-hand part of the diagram depicts the determination of the moisture difference value. To this end, the first step is to measure the web speed, whereupon it is possible to employ the data on coat thickness, moisture, base web basis weigh and coat solids content in the determination of the web moisture or change of moisture $\Delta H_2O$ at the ingoing side of a dryer. When the moisture set value is summed with the measured value, or the actual value, of web moisture, the result is the difference $\Delta M$ between the set value and the actual value, wherefrom is possible to compute the needed drying effect change $\Delta H_2O$ that must be summed with other possible changes caused by process deviations. On the basis of the thus obtained need for drying effect change, the needed drying effects and new dryer set values are computed with the help of the composite model of the process and the actual values of process conditions and process status. After computation, the new set values are transmitted to the dryers. In this diagram, the calender is depicted as one of the dryers in the spirit of the basic concept of modeling in the moisture control method according to the invention.

The method according to the invention can be applied to all kinds of paper/board coating and calendering techniques and equipment in which the web being treated is calendered and to the surface of the base web is possibly applied a liquid-based coating furnish that is dried on at least one dryer. Generally, however, the layout comprises plural dryers and, in fact, the benefits of the invention will be the greater the more complicated the equipment layout is. If the invention is applied to online calendering, wherein the web to be calendered enters the calender directly from a paper/boardmaking machine, the composite model must include at least one, preferably all, of the dryers located downstream from the web formation section of the papermaking machine, whereby the composite model can be configured in the same fashion as described above in the case of coater equipment. Hence, the modeling equation for making calendered paper comprises at least one submodel for a unit preceding the calender and one submodel describing the behavior of the calender.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A method for controlling a drying effect of an equipment layout used in making a calendered web of paper or board, the equipment layout comprising at least one calender unit and at least one web-processing unit preceding the at least one calender unit, the method comprising:

processing a web on at least one web-processing unit capable of affecting a moisture content of the web;

passing the web directly from the at least one web-processing unit to the calender unit;

calendering the web on the calender unit;

compiling, for each unit of the equipment layout wherein the moisture content of the web changes, an evaporation rate submodel capable of describing an amount of moisture change during web travel within the respective unit of the equipment layout, wherein at least one evaporation rate submodel is linked into a composite evaporation rate model;

determining a needed overall moisture evaporation effect of the equipment layout;

determining, by employing the composite evaporation rate model, a needed moisture evaporation effect for each unit of the equipment layout that is controllable in terms of a moisture evaporation rate; and controlling the moisture evaporation rate for each controllable unit of the equipment layout in accordance with the determined needed moisture evaporation effect.

2. The method of claim 1, wherein the calender unit is a multinip calender.

3. The method of claim 2, wherein the multinip calender is a supercalender.

4. The method of claim 2, further comprising compiling, for the multinip calender, a submodel comprising a plurality of partial submodels describing moisture behavior of nips of the multinip calender, of any drying and wetting units of the calender, and of any open draws of the calender.

5. The method of claim 1, wherein the calender unit is a soft-nip calender.

6. The method of claim 1, wherein the calender unit is a machine calender.

7. The method of claim 1, wherein the web processing unit comprises at least one drying unit, wherein the web is formed in a forming section of a papermaking or boardmaking machine, and wherein the composite evaporation rate model is compiled from a submodel for moisture behavior of the calender unit and from at least one submodel describing moisture behavior of at least one drying unit operating downstream of the web forming section.

8. The method of claim 7, wherein the composite rate model is compiled from submodels of each of the drying units.

9. The method of claim 7, wherein the calender unit is a multinip calender.

10. The method of claim 9, wherein the multinip calender is a supercalender.

11. The method of claim 1, wherein the web processing unit comprises at least one coater unit in which coating mix is applied to at least one surface of the web, and wherein the composite evaporation rate model is compiled from a submodel for moisture behavior of the calender unit and at least one submodel describing moisture behavior of at least one coater unit.

12. The method of claim 11, wherein the composite rate model is compiled from submodels of each of the coater units.

13. The method of claim 11, wherein the web processing unit comprises at least one drying unit downstream of a coater unit, and wherein the composite evaporation rate model is compiled from at least one submodel describing moisture behavior of at least one drying unit.

14. The method of claim 13, further comprising:

controlling an evaporation effect of one unit of the equipment layout with the composite evaporation rate model; and setting the evaporation effect of every other unit of the equipment layout to a fixed value.

15. The method of claim 14, further comprising:

varying operating parameters of the controlled unit of the equipment layout;

measuring web moisture values corresponding to said varying of the operating parameters;

comparing the measured web moisture values to web moisture values determined by employing, the composite evaporation rate model; and using the comparison of the measured web moisture values to web moisture values determined by employing the composite evaporation rate model to adjust parameters of the composite evaporation rate model so as to result in calculated web moisture values substantially the same as the measured web moisture values.

16. The method of claim 15, wherein a control signal to the controlled unit is changed in at least one of a stepwise manner and a superimposition of a pseudo-random binary signal (PRBS) on at least one set value.

17. The method of claim 13, further comprising:

controlling an evaporation effect of at least two units of the equipment layout with the composite evaporation rate model.

18. The method of claim 13, further comprising:

measuring a final moisture content of the web;

comparing the measured final moisture content with a desired moisture value; and controlling the moisture evaporation rate for at least one controllable unit of the equipment layout with the composite evaporation rate model.

19. The method of claim 18, further comprising:

measuring the web moisture at at least one point upstream of where the final moisture content is measured to determine at least one intermediate moisture content value; and controlling with the measured intermediate moisture content the moisture evaporation rate for at least one controllable unit of the equipment layout upstream of where the intermediate moisture content is measured.

20. The method of claim 18, wherein any needed change in the overall moisture evaporation effect is allocated among at least one controllable unit of the equipment layout using the composite evaporation rate model in accordance with at least one predetermined weighting factor.

21. The method of claim 13, further comprising:

measuring an initial moisture content of the web prior to entering a first of the at least one web-processing units; and controlling, using the composite evaporation rate model and the measured initial moisture content, an evaporation rate of at least one controllable unit of the equipment layout.

22. The method of claim 13, controlling an evaporation effect of at least one drying unit of the equipment layout with the composite evaporation rate model.

23. The method of claim 22, further comprising:

measuring the web moisture at at least one drying unit to determine at least one intermediate moisture content value; and controlling with the measured intermediate moisture content the moisture evaporation rate for tile at least one drying unit.

24. The method of claim 13, wherein an output value obtained from the evaporation rate submodel of a unit of the equipment layout is used as an input value in the evaporation rate submodel of a next successive unit of the equipment layout.

25. The method of claim 1, further comprising:

controlling an evaporation effect of one unit of the equipment layout with the composite evaporation rate model; and setting the evaporation effect of every other unit of the equipment layout to a fixed value.

26. The method of claim 1, further comprising:

controlling an evaporation effect of at least two units of the equipment layout with the composite evaporation rate model.

27. The method of claim 1, further comprising:

measuring a final moisture content of the web;

comparing the measured final moisture content with a desired moisture value; and controlling the moisture evaporation rate for at least one controllable unit of the equipment layout with the composite evaporation rate model.

28. The method of claim 27, further comprising:

measuring the web moisture at at least one point upstream of where the final moisture content is measured to determine at least one intermediate moisture content value; and controlling with the measured intermediate moisture content the moisture evaporation rate for at least one controllable unit of the equipment layout upstream of where the intermediate moisture content is measured.

29. The method of claim 27, wherein any needed change in the overall moisture evaporation effect is allocated among at least one controllable unit of the equipment layout using the composite evaporation rate model in accordance with at least one predetermined weighting factor.

30. The method of claim 1, further comprising:

measuring an initial moisture content of the web prior to entering a first of the at least one web-processing units; and controlling, using the composite evaporation rate model and the measured initial moisture content, an evaporation rate of at least one controllable unit of the equipment layout.

31. The method of claim 1, wherein an output value obtained from the evaporation rate submodel of a unit of the equipment layout is used as an input value in the evaporation rate submodel of a next successive unit of the equipment layout.

32. The method of claim 1, wherein the web processing unit comprises at least one coater unit and at least one drying unit, and wherein an output value obtained from the evaporation rate submodel of a unit of the equipment layout is used as an input value in the evaporation rate submodel of a next successive unit of the equipment layout.

* * * * *